US006101689A

United States Patent [19]

Jo

[11] Patent Number: 6,101,689

[45] Date of Patent: Aug. 15, 2000

[54] DOUBLE CLIP WITH SELF-ADJUSTING JAW

[76] Inventor: Alejandro Jo, 2a Calle 18-71 Zona 15, VH.1, Guatemala, Guatemala

[21] Appl. No.: 09/387,939

[22] Filed: Sep. 1, 1999

[51] Int. Cl.[7] ..... A44B 21/00; A45F 5/00

[52] U.S. Cl. ..... 24/338; 24/332; 24/334; 24/346; 24/535

[58] Field of Search ..... 24/332, 334, 335, 24/338, 3.11, 3.1, 3.12, 535, 532, 495, 557, 346, 349, 343, 564, 493, 487; 223/93, 96

[56] References Cited

U.S. PATENT DOCUMENTS

| | | | |
|---|---|---|---|
| D. 335,078 | 4/1993 | Hampshire . | |
| 545,384 | 8/1895 | Sichler | 24/334 |
| 631,877 | 8/1899 | Odson | 24/332 |
| 748,423 | 12/1903 | Schaffner | 24/564 X |
| 1,012,594 | 12/1911 | Cain et al. | 24/338 |
| 1,729,930 | 10/1929 | Dills | 24/332 |
| 2,782,482 | 2/1957 | Baril et al. | 24/501 |
| 3,131,449 | 5/1964 | Iida | 24/334 |
| 4,352,476 | 10/1982 | Meeks | 24/535 X |
| 4,763,390 | 8/1988 | Rooz | 24/487 |
| 4,780,934 | 11/1988 | Vickers et al. | 24/3.11 |
| 5,385,282 | 1/1995 | Chen | 224/669 |
| 5,809,623 | 9/1998 | Dykstra | 24/535 X |
| 5,863,021 | 1/1999 | Nichols | 24/332 X |

*Primary Examiner*—Anthony Knight
*Assistant Examiner*—Robert J. Sandy
*Attorney, Agent, or Firm*—Jack Lo

[57] ABSTRACT

A double clip is comprised of outer and middle jaws pivoted together about an outer axle and biased to a closed position by a first spring. A pivoted gripping member is pivoted to the distal end of the outer jaw. An inner jaw is pivoted to the middle jaw about an inner axle and biased to a closed position by a second spring. The clip is removably attached to clothing by clipping the clothing between the inner and middle jaws. An item to be carried is removably clipped between the outer and middle jaws. The pivoted gripping member is automatically maintained in a parallel relationship with the middle jaw, regardless of the thickness of the item.

3 Claims, 2 Drawing Sheets

DOUBLE CLIP WITH SELF-ADJUSTING JAW

BACKGROUND OF THE INVENTION

1. Field of the Invention

This invention relates generally to clips for attaching items to clothing.

2. Prior Art

Clips are often used to removably attach items to a person's clothing. However, no prior art clip can removably grip an item and be removably attached to clothing at the same time. E.g., U.S. patent shows a simple spring-loaded clip comprised of two jaws pivoted together and biased closed by a spring. While it is gripping an item, it cannot be attached to clothing, i.e., it can either grip the item or clothing, but not both at the same time. U.S. Pat. No. 4,780,934 to Vickers et al. shows a clip with a single spring-loaded jaw pivoted to a mounting plate, which is permanently attached to an item, e.g., a beeper. The item is inseparable from the clip, so that the clip must also be detached from the clothing to detach the item. U.S. Pat. No. 5,385,282 to Chen shows a beeper holder comprised of a spring-loaded jaw pivoted to a mounting plate, which is in turn pivoted to a beeper bracket. The mounting plate is not spring-loaded. Removing the pager also requires the removal of the clip.

Further, all prior art clips include jaws which define different angles when opened to different widths. They generally converge when gripping a thin item. The gripping force is concentrated along the tips of the jaws, which may produce a disfiguring mark on a soft item. The jaws diverge when gripping a very thick item, so that the item would tend to slip out.

OBJECTS OF THE INVENTION

Accordingly, objects of the present double clip with self-adjusting jaw are:

to removably attach itself to clothing;

to removably attach an item to clothing;

to be able to release the item without having to be detached from the clothing; and to grip items without producing disfiguring marks; and to grip items of different thickness equally securely.

Further objects of the present invention will become apparent from a consideration of the drawings and ensuing description.

BRIEF SUMMARY OF THE INVENTION

A double clip is comprised of outer and middle jaws pivoted together about an outer axle and biased to a closed position by a first spring. A pivoted gripping member is pivoted to the distal end of the outer jaw. An inner jaw is pivoted to the middle jaw about an inner axle and biased to a closed position by a second spring. The clip is removably attached to clothing by clipping the clothing between the inner and middle jaws. An item to be carried is removably clipped between the outer and middle jaws. The pivoted gripping member is automatically maintained in a parallel relationship with the middle jaw, regardless of the thickness of the item.

Figure 1:
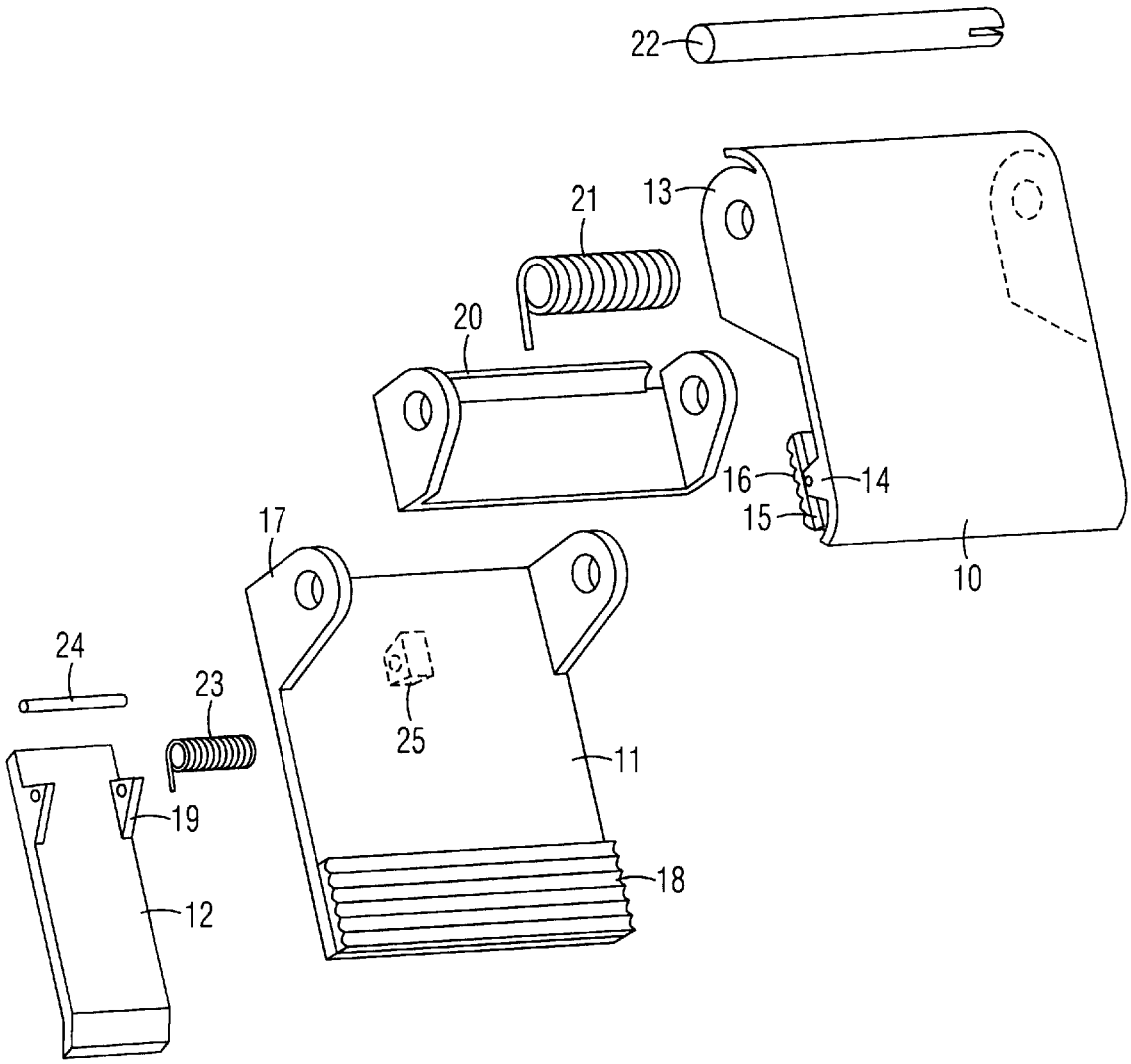
FIG. 1 is an exploded view of the present double clip.

| DRAWING REFERENCE NUMERALS | |
|---|---|
| 10. Outer Jaw | 11. Middle Jaw |
| 12. Inner Jaw | 13. Side Brackets |
| 14. Side Brackets | 15. Pivoted Gripping Member |
| 16. Resilient Gripping Pad | 17. Side Brackets |
| 18. Resilient Gripping Pad | 19. Side Brackets |
| 20. Retaining Bracket | 21. First Spring |
| 22. Outer Axle | 23. Second Spring |
| 24. Inner Axle | 25. Fulcrum |
| 26. Belt | 27. Pants |
| 28. Gloves | |

DETAILED DESCRIPTION OF THE INVENTION

FIG. 1

A preferred embodiment of the double clip is shown in the exploded view in FIG. 1. It includes an outer jaw 10, a middle jaw 11, and an inner jaw 12. Outer jaw 10 includes a first pair of side brackets 13 at a proximal end, and a second pair of side brackets 14 at a distal end. A pivoted gripping member 15 is pivotally mounted between side brackets 14. A resilient pad 16 is attached to gripping member 15. Middle jaw 11 includes a pair of side brackets 17 at a proximal end, and a resilient gripping pad 18 attached to its distal end. Inner jaw 12 includes a pair of side brackets 19 at its proximal end.

A retaining bracket 20 is for being positioned between the proximal ends of outer jaw 10 and middle jaw 11, and between side brackets 17 of middle jaw 11. A first spring 21 is for being positioned within retaining bracket 20. An outer axle 22 is for being positioned through side brackets 13 of outer jaw 10, first spring 21, retaining bracket 20, and side brackets 17 of middle jaw 11. A second spring 23 is for being positioned between side brackets 19 of inner jaw 12. An inner axle 24 is for being positioned through side brackets 19 of inner jaw 12, second spring 23, and a fulcrum 25 on the back side of middle jaw 11.

FIGS. 2–3

Figure 2:
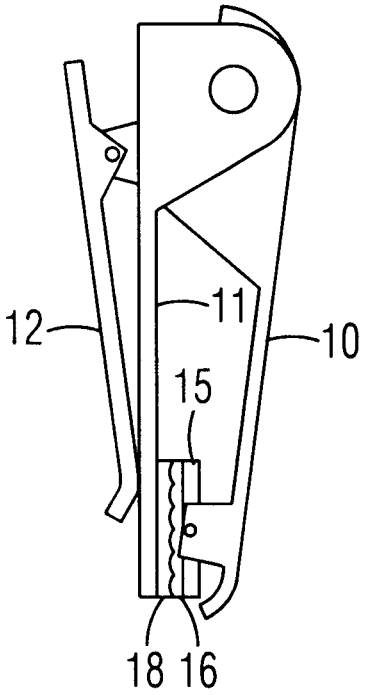
FIG. 2 is a side view of the assembled double clip.

The double clip is shown assembled in a side view in FIG. 2. Outer jaw 10 is pivotally connected to the outer side of middle jaw 11, and inner jaw 12 is pivotally connected to the inner side of middle jaw 11. The distal ends of outer jaw 10 and middle jaw 11 are biased to a closed position against each other by first spring 21 (FIG. 1), and the distal ends of inner jaw 12 and middle jaw 11 are biased to a closed position against each other by second spring 23 (FIG. 1).

Figure 3:
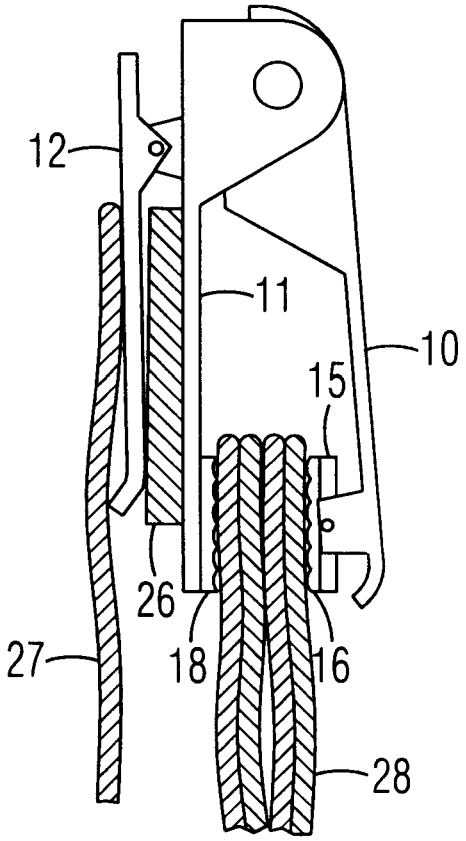
FIG. 3 is a side view of the double clip attached to clothing and holding an item.

The double clip is shown in use in FIG. 3. It is attached to clothing, such as a belt 26 on pants 27, by positioning belt 26 between inner jaw 12 and middle jaw 11. An item or items, such as gloves 28, are removably attached to the clothing by being gripped between outer jaw 10 and middle jaw 11, specifically, between gripping member 15 and middle jaw 11. Pivoted gripping member 15 is automatically pivoted to maintain a parallel relationship with middle jaw 11, so that it will securely grip the item, regardless of the thickness of the item. The parallel relationship between gripping member 15 and middle jaw 11 ensures that the gripping force is spread across the width of gripping member 15 to avoid producing a disfiguring mark on the item. Resilient gripping pads 16 and 18 ensure a secure grip, and also help to avoid disfiguring the item. The item can thus be released without removing the double clip from the clothing, so that the double clip is ready for attaching any other item to the clothing.

SUMMARY AND SCOPE

Accordingly, a double clip is provided. It removably attaches itself to clothing. It removably attaches an item to clothing. It can release the item without being detached from the clothing, so that it is ready for gripping any other item. It grips items without causing disfiguring marks. It also grips items of different thickness equally securely.

Although the above description is specific, it should not be considered as a limitation on the scope of the invention, but only as an example of the preferred embodiment. Many variations are possible within the teachings of the invention. For example, pivoting gripping member 15 can be attached to middle jaw 11 instead of outer jaw 10, or two gripping members can be respectively attached to outer jaw 10 and middle jaw 11. The double clip can be attached to anything in addition to clothing, and can be used for holding anything in addition to gloves. Therefore, the scope of the invention should be determined by the appended claims and their legal equivalents, not by the examples given.

I claim:

1. A self-adjusting clip, comprising:

a first jaw with a proximal end and a distal end;

a second jaw with a proximal end and a distal end, said second jaw pivoted to said first jaw at said proximal ends about a transverse axis;

a gripping member pivoted to said distal end of said first jaw about a gripping member axis parallel to said transverse axis, said gripping member and said second jaw for gripping an item there between, said gripping member being automatically maintained in a parallel relationship with said second jaw regardless of a thickness of said item for a secure grip;

wherein said first jaw includes a first pair of side brackets at said proximal end thereof, and a second pair of side brackets at said distal end thereof, said gripping member being pivoted between said second pair of side brackets, said second jaw includes a pair of side brackets at said proximal end thereof, said first pair of side brackets of said first jaw being hinged to said pair of side brackets of said second jaw.

2. A double clip, comprising:

an outer jaw with a proximal end and a distal end;

a middle jaw with a proximal end and a distal end, an outer side of said middle jaw pivoted to said outer jaw at said proximal ends thereof about an outer axis and biased to a closed position by a first spring; and an inner jaw with a proximal end and a distal end, said inner jaw pivoted to an inner side of said middle jaw about an inner axis and biased to a closed position by a second spring, said clip for removably attaching to clothing by clipping said clothing between said inner jaw and said middle jaw, said clip is further for carrying an item by clipping said item between said outer jaw and said middle jaw;

wherein said outer jaw includes a first pair of side brackets at said proximal end thereof, a second pair of side brackets at said distal end thereof, and a gripping member pivoted between said second pair of side brackets, said middle jaw includes a pair of side brackets at said proximal end thereof, said first pair of side brackets of said outer jaw being hinged to said pair of side brackets of said middle jaw, said middle jaw including a fulcrum on said inner side thereof, said inner jaw including a pair of side brackets on said proximal thereof hinged to said fulcrum.

3. A double clip, comprising:

an outer jaw with a proximal end and a distal end;

a middle jaw with a proximal end and a distal end, an outer side of said middle jaw pivoted to said outer jaw at said proximal ends thereof about an outer axis and biased to a closed position by a first spring;

an inner jaw with a proximal end and a distal end, said inner jaw pivoted to an inner side of said middle jaw about an inner axis and biased to a closed position by a second spring, said clip for removably attaching to clothing by clipping said clothing between said inner jaw and said middle jaw, said clip is further for carrying an item by clipping said item between said outer jaw and said middle jaw; and a gripping member pivoted to said distal end of said outer jaw about a gripping member axis parallel to said outer axis, said gripping member and said middle jaw for gripping an item there between, said gripping member being automatically maintained in a parallel relationship with said middle jaw regardless of a thickness of said item for a secure grip;

wherein said outer jaw includes a first pair of side brackets at said proximal end thereof, and a second pair of side brackets at said distal end thereof, said gripping member being pivoted between said second pair of side brackets, said middle jaw includes a pair of side brackets at said proximal end thereof, said first pair of side brackets of said outer jaw being hinged to said pair of side brackets of said middle jaw, said middle jaw including a fulcrum on said inner side thereof, said inner jaw including a pair of side brackets on said proximal thereof hinged to said fulcrum.

* * * * *